US006244439B1

(12) United States Patent
Dennis

(10) Patent No.: US 6,244,439 B1
(45) Date of Patent: Jun. 12, 2001

(54) PORTABLE DOLL CAROUSEL

(76) Inventor: Gerald Dennis, 1155 Warburton Ave., Yonkers, NY (US) 10701

( * ) Notice: Subject to any disclaimer, the term of this patent is extended or adjusted under 35 U.S.C. 154(b) by 0 days.

(21) Appl. No.: 08/851,643

(22) Filed: May 6, 1997

(51) Int. Cl.[7] ..... B65D 73/00

(52) U.S. Cl. ..... 206/457; 206/782; 220/524; 229/109

(58) Field of Search ..... 206/457, 458, 206/459.5, 508, 509, 561, 781–783; 211/163; 220/524, 528, 552; 229/109–110; 312/125, 266, 267, 269

(56) References Cited

U.S. PATENT DOCUMENTS 2,903,127 * 9/1959 Dorman ..... 220/552
3,314,532 * 4/1967 Henry ..... 206/782
4,431,238 * 2/1984 Evans ..... 312/125
4,850,506 * 7/1989 Heaps, Jr. et al. ..... 229/109
5,115,965 * 5/1992 Girona Alepuz ..... 229/109
5,549,373 * 8/1996 Bustos ..... 312/125

* cited by examiner

*Primary Examiner*—Paul T. Sewell
*Assistant Examiner*—Luan K. Bui
(74) *Attorney, Agent, or Firm*—Thomas A. Beck

(57) ABSTRACT

A carousel suitable for storing dolls having a plurality of compartments with doors opening into each compartment and a top storage above the compartments with doors that cover the storage space and for the top of the carousel.

6 Claims, 10 Drawing Sheets

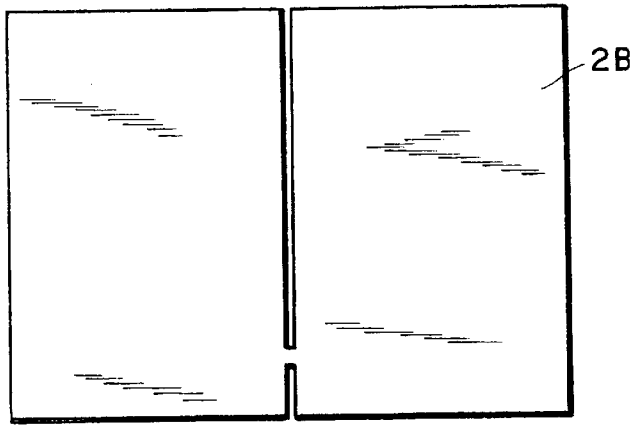
FIG.IB
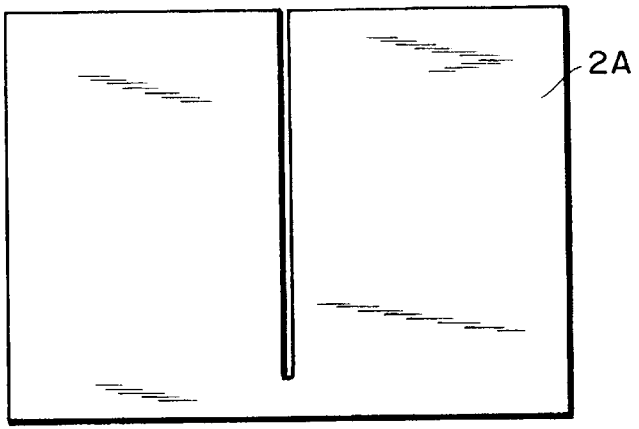
FIG.IA
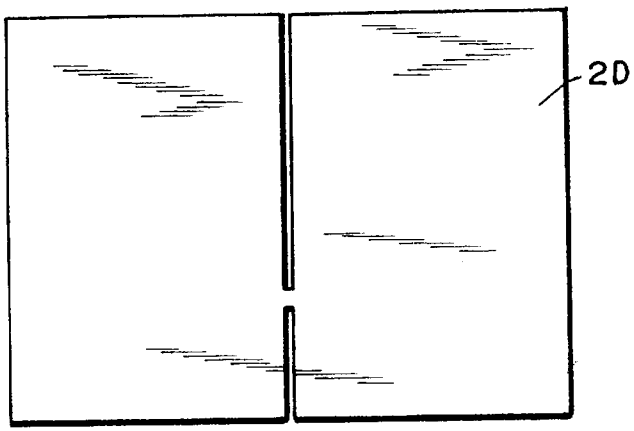
FIG.ID
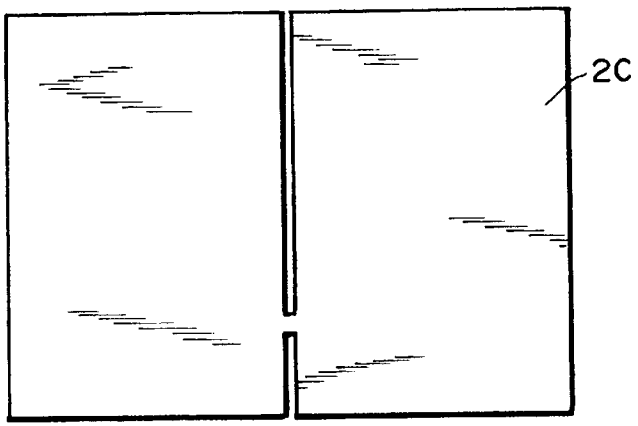
FIG.IC

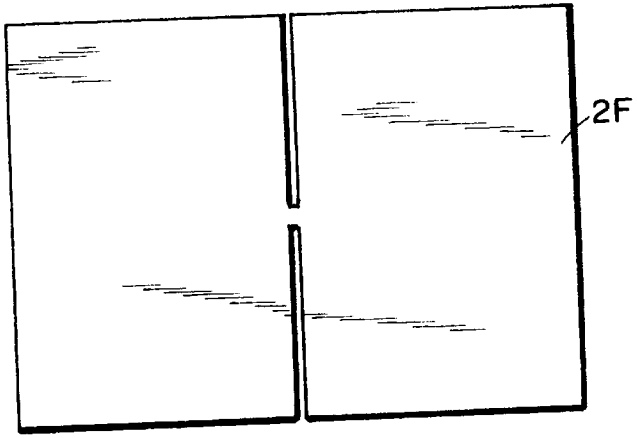
FIG.IF
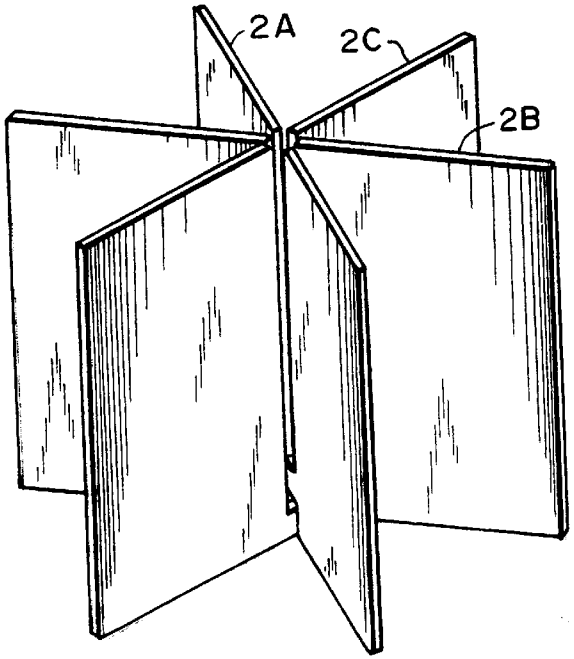
FIG.2B
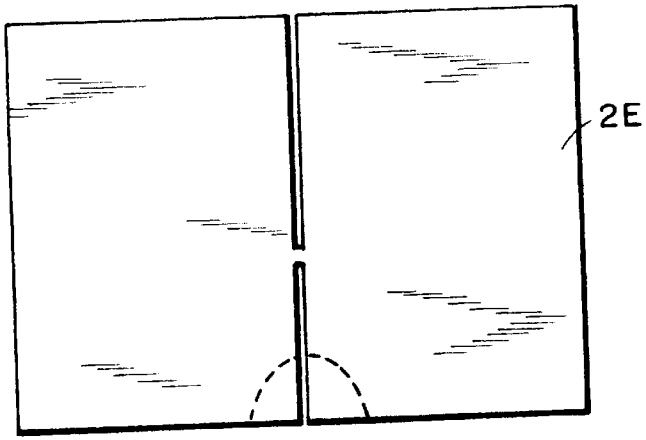
FIG.IE
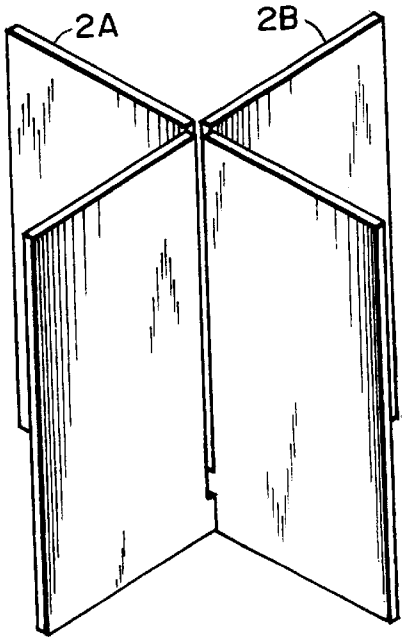
FIG.2A

PORTABLE DOLL CAROUSEL

BACKGROUND OF THE INVENTION

1. Technical Field of the Invention

The present invention relates generally to a portable assembly suitable for enclosing and storing a plurality of toy dolls. More particularly, the present invention relates to a structural unit which stores as many as twelve toy dolls in separate compartments located therein along with up to four additional storage spaces in the top of the unit.

2. Description of the Related Art

The prior art contains diverse references that disclose the use of compartmentalized containers, but none disclose the specific structure of the unit of the present invention.

U.S. Pat. No. 3,967,772 discloses a collapsible and reusable container formed from a base member, a collar and divider members. The base portion defines a hexagon and each of the divider members constitutes a complete triangle to subdivide the base area into triangular compartments. The container collar comprises a continuous peripheral side elements that does not open. The container does not possess a top or lid. Thus, lacking the elements noted, it is not anticipatory of the assembly of the present invention.

U.S. Pat. No. 3,403,835 discloses a folded blank container of the multicell type which can be transported or stored preassembled in flat, collapsed condition and erected at the point of filling or use. The sides do not open nor does the assembly have a top as is the case in the present invention.

U.S. Pat. No. 3,937,392 discloses a container adapted for the bulk packaging of dry flow granular or powder material and more especially to a drum shaped container therefor. The container has a combination of elements including inner and outer collapsible tubular members together with a pair of inner and outer collapsible top and bottom end closure caps for said tubular members. The structure does not contain the elements of the present invention as the sides of the container are continuous and do not open.

U.S. Pat. No. 1,108,005 discloses a container adapted to hold cigars which comprises a multicellular package cylindrical or hexagonal in shape which may be opened out longitudinally of its length in two halves. The cells are permanently closed at one end.

U.S. Pat. Nos. 1,260,912 and 1,522,201 disclose decorated receptacles for storing articles. These receptacles do not contain the structure of the present invention.

U.S. Pat. No. 5,224,894 discloses a container and container lid which enclose a figurine. The figurine is stored in the container. The container is turned inside out to arrive at a doll configuration. The structure does not anticipate the structure of the assembly of the present invention.

U.S. Pat. Nos. 3,442,512, 4,040,206, 5,169,354 and 5,226,845 disclose dolls or containers, none of which anticipate the assembly of the present invention.

Other objects and features as well as additional details of the present invention will become apparent from the following detailed description and annexed drawings of the presently preferred embodiments thereof, when considered in conjunction with the drawings.

SUMMARY OF THE INVENTION

The present invention relates to a portable doll storage container which is also referred to herein as a "carousel." The carousel contains a number of individual compartments in which dolls are stored. The carousel of the present invention with its doll storage compartments is formed from a base and a segmented wall surrounding the base and conforming to the shape of the base. The base thus defines the peripheral configuration of the carousel. As noted the wall is divided into segments, with each segment having a door which provides access to the compartments within the carousel wherein the dolls are stored. Each of the wall segments comprises a header located above the door. Each side of the header is connected to sides of adjacent header segments. Thus the headers form a continuous element around the circumference of the unit. Each door immediately beneath the header is fixedly attached along one of its vertical edges to a jamb that is attached to the header and extends vertically and is secured to the base. The other vertical edge of each door is not fixed and thus can be arcuately rotated to an open and closed position. More specifically, adjacent each of the edges of each of the doors is a pivot jamb and a lock jamb.

Each segment of the wall has an exterior face, an interior face, is of identical height and width, and has a bottom edge positioned adjacent said base. As noted, each of the side edges are positioned in juxtaposition to side edges of adjacent segmented wall elements. This arrangement forms a polygon shaped cavity in combination with said base. Depending upon the number of front walls, the carousel can be a square, hexagon, octagon, etc. in shape.

Within the walls of the carousel, there are a plurality of continuous interior wall partitions having top, bottom and side edges. The partitions are slotted and intersect one another along their mid-planes. The interior wall partitions have the same height as the height of the segmented walls that form the polygon shape of the carousel. The bottom edges of the interior wall partitions located within said polygon shaped cavity contact the base and the top edges of the interior wall partitions contact and provide a support network for the floor of the top storage section of the carousel located above the doll storage compartments.

In accordance with the present invention, there are 2n compartments within the carousel, where n is the number of interior wall partitions.

The exterior underside of the base is designed to include a plurality of feet that support the unit. The feet are positioned o:)n the bottom surface of base to support the carousel evenly. In the preferred embodiment, there are five feet that support the unit. Four out of five of the feet are spread evenly around the edges of the bottom surface of the unit with the fifth positioned in the center of the bottom surface.

A tray is used in combination with the carousel of the present invention to stack a plurality of carousels on top of one another. The tray comprises a base member with legs extending downwardly from the bottom side of the tray. On the top surface of the tray opposite to the location of the legs, indentations corresponding to the cross sectional area of the legs are impressed in the surface. These indentations will receive the legs of other trays when stacked one on top of the other.

Finally, above the floor member of the storage compartment a suitable distance, the carousel possesses a top member which is secured to said top edges of the segments comprising the wall.

As noted, the portable doll storage container has a plurality of additional storage compartments above the doll storage compartments. The compartments are formed by at least one divider sheet having first and second side edges extending radially between said interior faces of the segmented front wall, and fixed thereto. The divider sheet also has top and bottom edges. The top of the portable doll storage carousel may comprise one or more sections, each being hingedly fixed to said top edge of the divider sheet and not secured to the top edges of the wall segments.

BRIEF DESCRIPTION OF THE DRAWINGS

In the drawings:

FIGS. 1A to 1F depicts a plurality of interior wall partitions used in one embodiment of the assembly of the present invention.

FIGS. 2A to 2E are orthogonal views of the interior wall partitions of FIG. 1 assembled to form a plurality of interior compartments in the assembly of the present invention.

DETAILED DESCRIPTION OF THE PRESENTLY PREFERRED EMBODIMENTS

Figure 2E:
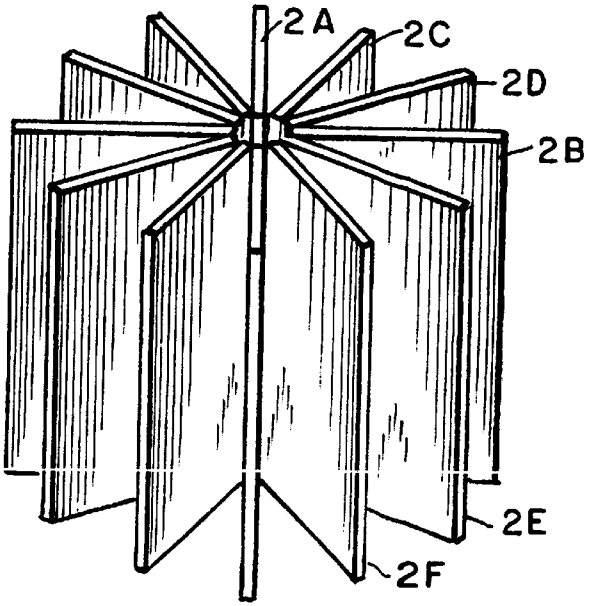
Figure 2C:
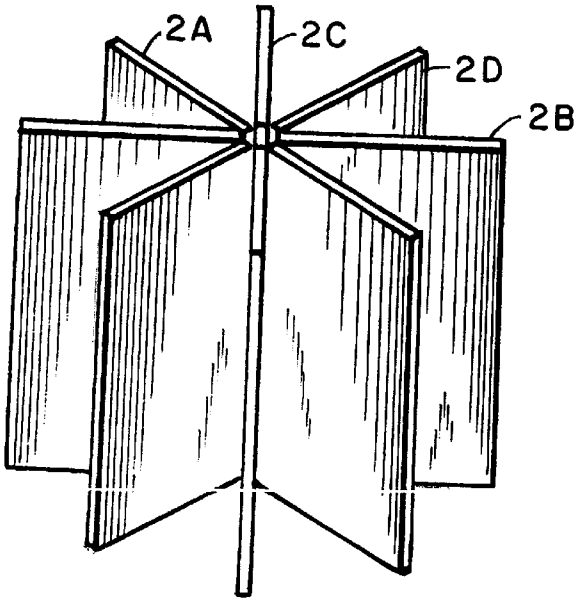
Figure 2D:
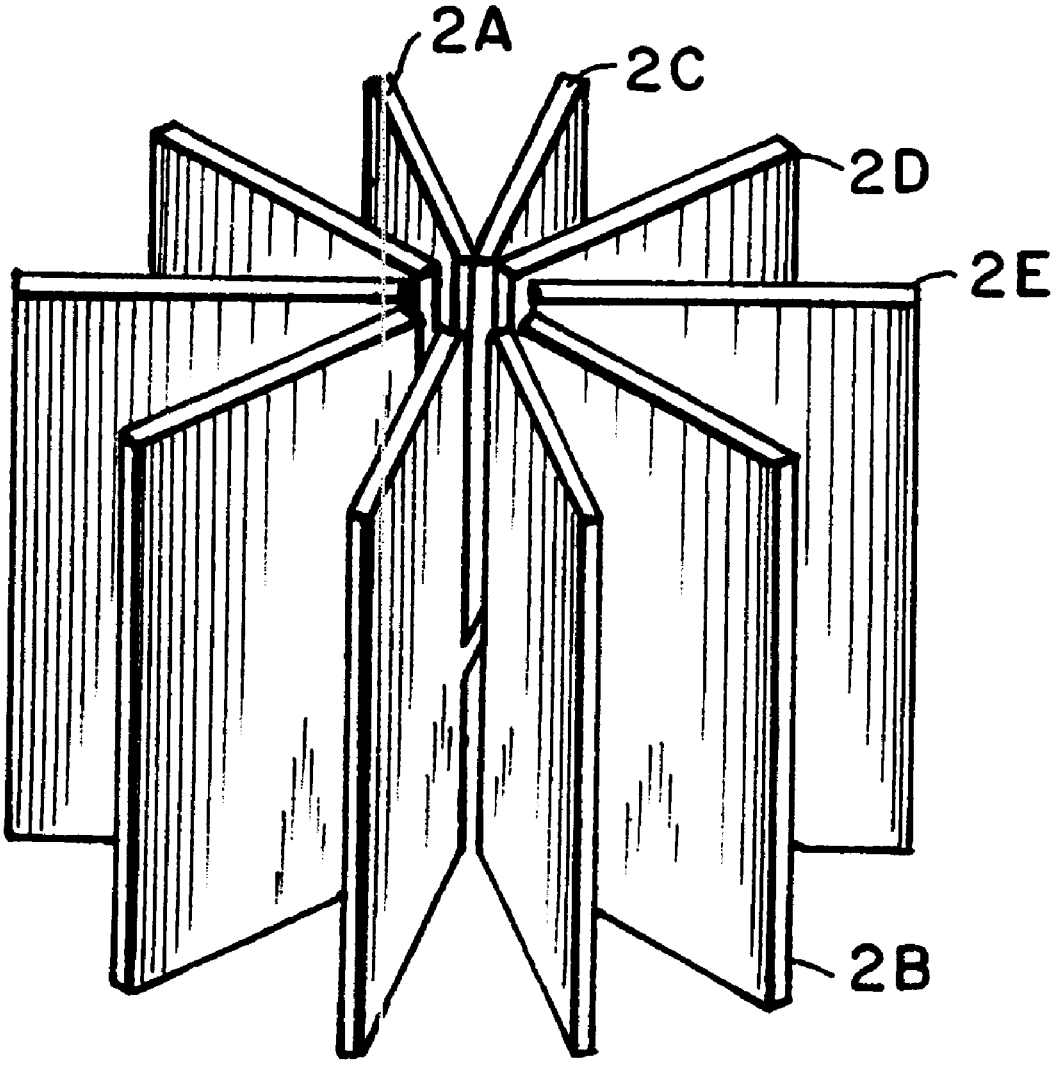
Figure 7:
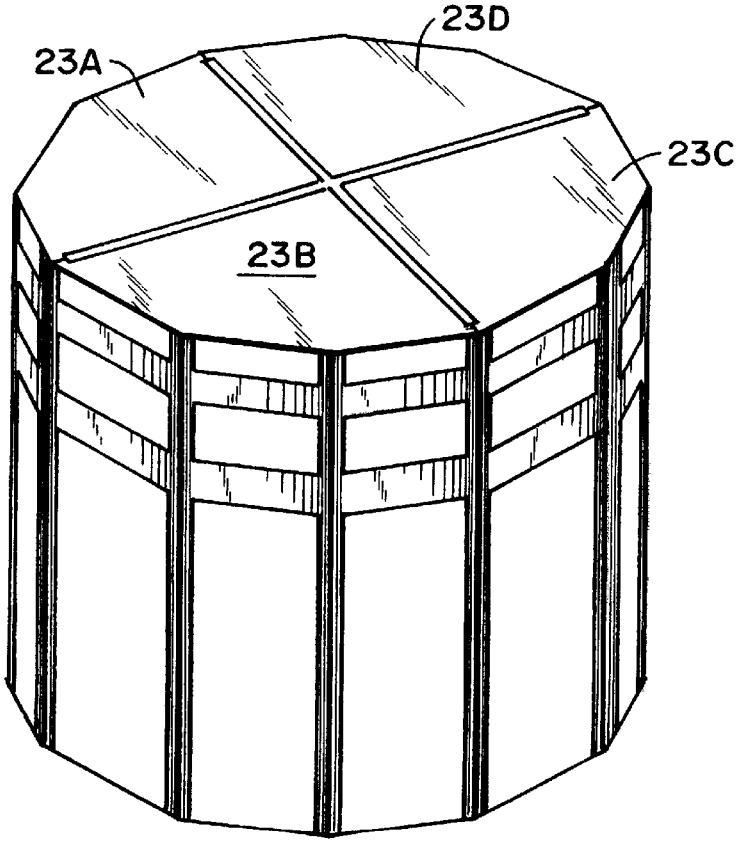
FIG. 7 is an orthogonal view of the fully assembled carousel of the present invention with labels.

Referring to the drawings, FIG. 7 depicts the carousel 1 of the present invention with its sides and top (bottom not shown). Carousel assembly 1 comprises a plurality of elements. One of the elements of the structure of the carousel is formed by selecting interior wall partitions shown as in FIG. 1 as panels 2A though 2F of any convenient dimensions. Interior wall partitions are slotted at one or both ends, as depicted, in such manner that allows them to be assembled in such manner to result in the configuration depicted in FIG. 2. In the embodiment depicted in FIG. 1, each of the six interior wall partitions possesses slightly different length slits. The interior wall partitions 2A through 2F are made from a hard, relatively thin plastic sheet which is designed to provide strength and durability to the assembly structure. In view of the size of various dolls currently on the market, the panels may conveniently measure 17 inches long by 12 inches high. These measurements are optional of course depending upon the needs of the user.

Optionally, at the center of the interior wall partitions depicted at FIG. 1E in dotted line, at the center-bottom, a semi-circle or other convenient opening is cut out. The opening is used to support the carrying strap 27 depicted in FIG. 7. Carrying strap is designed to support the weight of portable carousel 1 full with its weight and accessories. The strap is made from a durable cord or strap extending through the top center of the unit to the bottom of the unit, and is secured under or at the center of the cross section created by the interior wall partitions.

FIG. 2 is an orthogonal view depicting the sequence of assembling the interior wall partitions 2A to 2F to form the compartments that are embodied within the carousel when completely assembled. The number of compartments available in any embodiment of the invention as a function of the number of interior wall partitions is 2n where n is the number of interior wall partition sheets.

Figure 3:
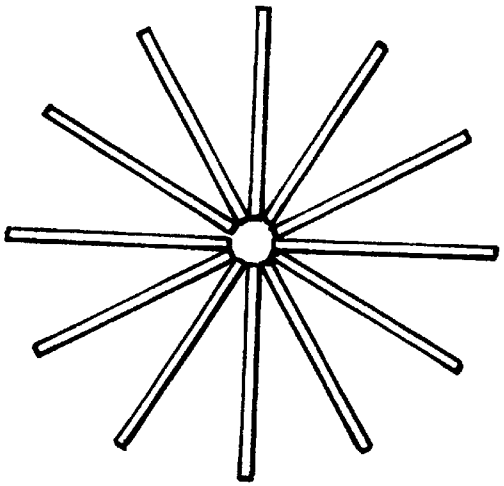
FIG. 3 is a top view of one of the embodiments having six inside panels.

FIG. 3 depicts a top view of the six interior wall partitions 2A through 2F shown in FIGS. 1 and 2 assembled to form twelve interior compartments.

Figure 4:
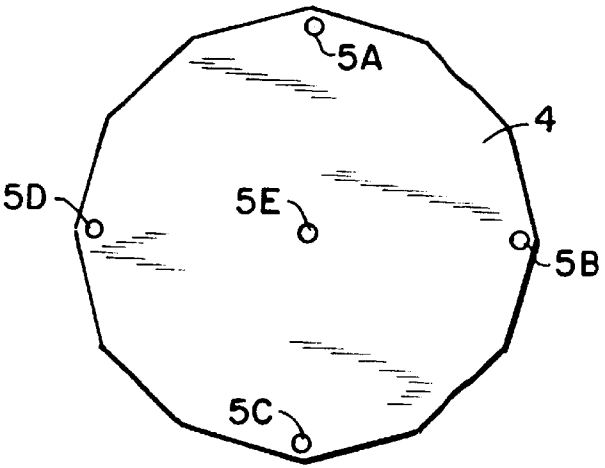
FIG. 4 is a bottom view of the carousel assembly showing the feet.

Referring to FIG. 4, carousel assembly 1 is supported by means of a base 3 which serves as the bottom or floor of the unit. Base 3 generally has a polygonal shape. As with the interior wall partitions 2A through 2F, base 3 is constructed from a hard thin sheet of plastic. The top of base 3 (not shown is preferably a smooth surface. Bottom 4 of base 3 is designed to include a plurality of feet 5A to 5E that support the unit. Feet 5A to 5E are positioned on the bottom surface of base 3 to support the carousel evenly. In the preferred embodiment as shown, there are five feet 5A to 5E that support the unit. Four (5A to 5D) out of five of the feet are spread evenly around the edges of the bottom surface of the unit with the fifth (5E) positioned in the center of the bottom surface 4. The feet may conveniently be made from durable rubber adhered to the bottom surface with rubber cement; however the feet may be made from any suitable thermoplastic or thermoset material and adhered to the bottom surface with any suitable adhesive.

Figure 5:
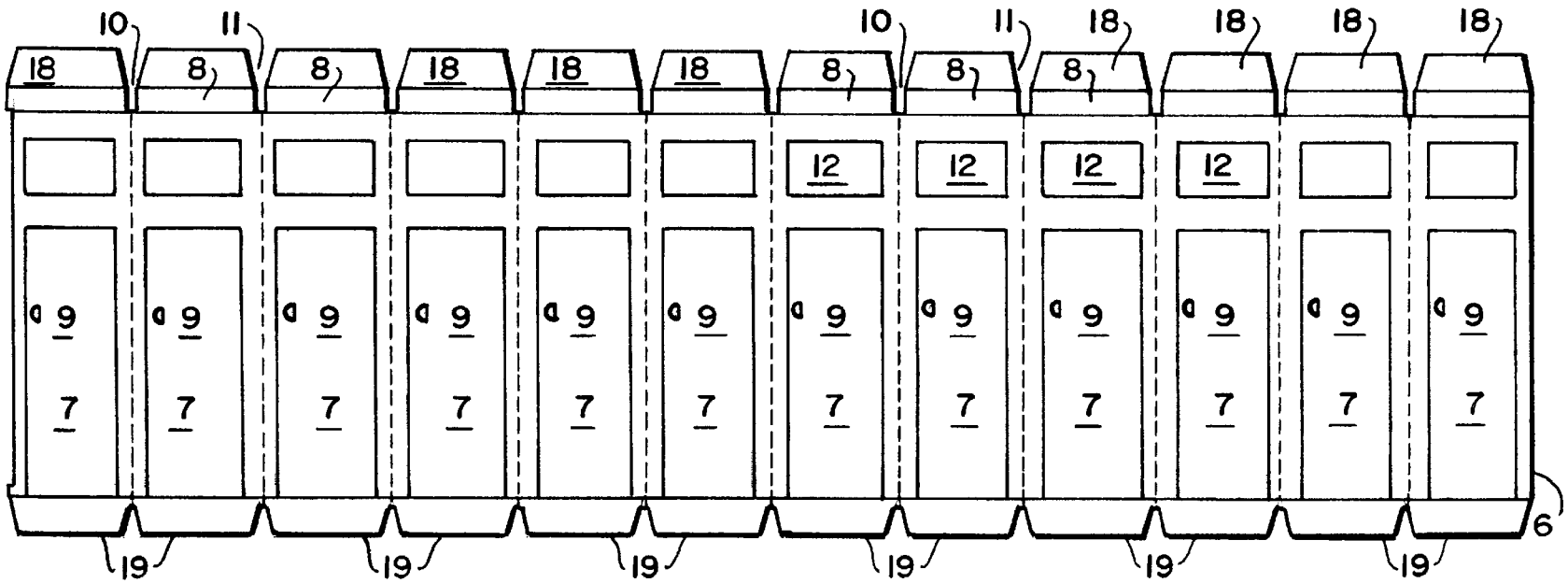
FIG. 5 is a front view of the exterior of the outside walls of the carousel.

FIG. 5 depicts the front surface of the exterior wall 6 surrounding carousel assembly 1. Exterior wall 6 is comprised of a plurality of individual segments 7, the number of said segments corresponding to the number of sides of the polygon that forms base 3. At the upper surface of each wall segment 7, there is a tab 18, and at the lower surface of wall segment 7 there is a tab 19; each of these tabs 18, 19 is designed to be adhered to a strip (not shown) inside the top of the unit and to base. Exterior wall 6 surrounds interior wall partitions (not shown). The length of exterior wall 6 and segmented sections 7 may be any dimension consistent with the dimensions of the other elements in the assembly.

In the case of the preferred embodiment as shown, the length of exterior wall 6 is 51 inches and its height is 15¼ inches. Segments 7 are defined by a crease in exterior wall 6 approximately every 4½ inches to support placement of the interior wall partitions that combine to form the individual compartments. Wall 6 may be constructed of flexible plastic or cardboard which may be covered with a padded colored soft plastic. It is emphasized that the dimensions given herein are illustrative, and may be varied depending upon the desires of the user or manufacturer.

Each segment 7 has a header 8 which is positioned immediately above a door 9. The headers 8 are interconnected and thus form a continuous strip around the periphery of the unit. The height of header 8 determines the amount of storage space that will be available in the top section of the carousel.

Headers 8 of each of the segments 7 form the perimeter of the top storage compartment (See FIG. 6) and are secured to the sections adjacent each side so that the sections form a continuous element.

Beneath each header 8 is a door 9 which is framed by two jambs, pivot jamb 10 and lock jamb 11, the base 3 and header 8. Door 9, in each case, is attached along one of its vertical sides to pivot jamb 10 which is attached to header 8 and base 3. Lock jamb 11 on the opposite side of door 9 is also fixed to header 8 and base 3. Door 9 fits within the framework defined by header 8, base 3, and pivot and lock jambs 10 and 11 and is secured in place by any suitable locking means. Door 9 can be opened out or closed as desired. Each lock jamb 11 is adjacent and affixed to the pivot jamb 10 of the segment 7 immediately adjacent to it; and conversely, each pivot jamb 10 is adjacent and fixedly attached to the lock jamb 11 immediately adjacent to it.

In the preferred embodiment, the door 9 contains a name plate 12 thereon along with a door handle 13.

Figure 6:
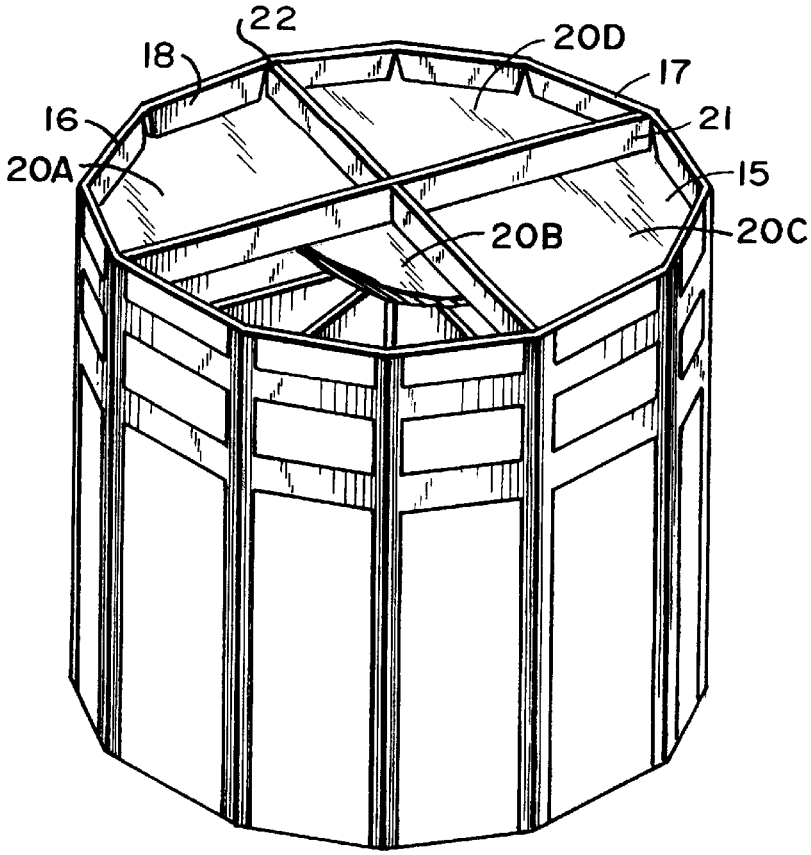
FIG. 6 is an orthogonal view of the assembled carousel depicting the storage space located in the top of the carousel without the top in place.

The carousel assembly of the present invention shown in FIG. 6 has a storage area 14 with an inner top 15 which serves as the top of the doll storage compartments formed by the inner wall partitions and also serves as the base of the area of the carousel used to store miscellaneous articles which are used in conjunction with the dolls. Inner top 15 is a smooth sheet which optionally may integrally contain a lip 16 that turns up at its circumferential edge 17 to which tabs 18 from the top of wall are turned down and attached. Alternatively, a continuous reinforcing strip 16 around the interior periphery 17 of miscellaneous article storage area 14 may be inserted between the back side of header 8 and tab 18.

FIG. 6 depicts four miscellaneous article storage compartments 20A to 20D. As with the interior wall partitions (See FIGS. 2A–2E), the miscellaneous article storage area 14 is divided into discrete sections by intersecting smaller sheet strips 21, 22 made from sheets of any suitable material such as plastic. In the preferred embodiment, storage space 14 can be 1¼ inches deep and divided by two 1¼ inch plastic strips 21, 22 which produce four separate storage areas 20A to 20D. If additional storage sections in area 14 are desired, additional strips can be incorporated into the unit. The number of storage sections is 2n where n is the number of strips used.

Attached to each half of plastic strips 21, 22 in the top storage section is an individual cover 23A to 23D which in combination cover the carousel and form a top thereon. The edge of each individual cover 23 is rotatably affixed to the edge of plastic strip 21 or 22 to allow top 23 to be raised or lowered to open or close the storage compartment area. Each top 23 is formed to conform to the quadrant or portion of the polygon shape that it covers. Each top 23A to 23D lifts up revealing the storage space in the quadrant or section beneath.

FIG. 7 depicts the tops 23A to 23D in place covering the miscellaneous article compartments therebeneath. The tops are in contact with the top edge of wall 6.

Figure 8:
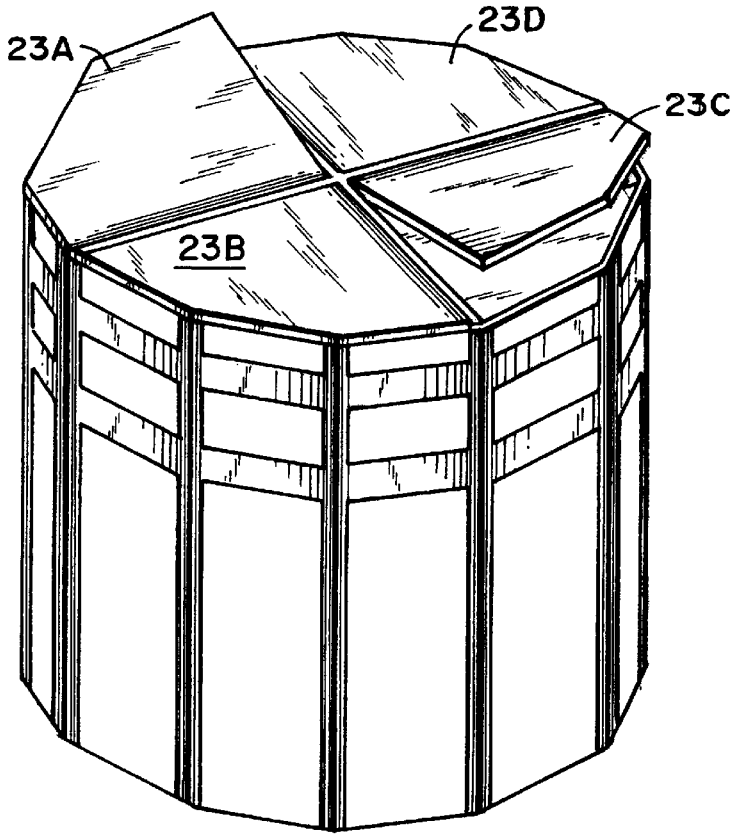
FIG. 8 is an orthogonal view of the fully assembled carousel of the present invention with the top cover doors opened.

FIG. 8 depicts carousel 1 with tops 23A to 23D in partially raised position.

Figure 9:
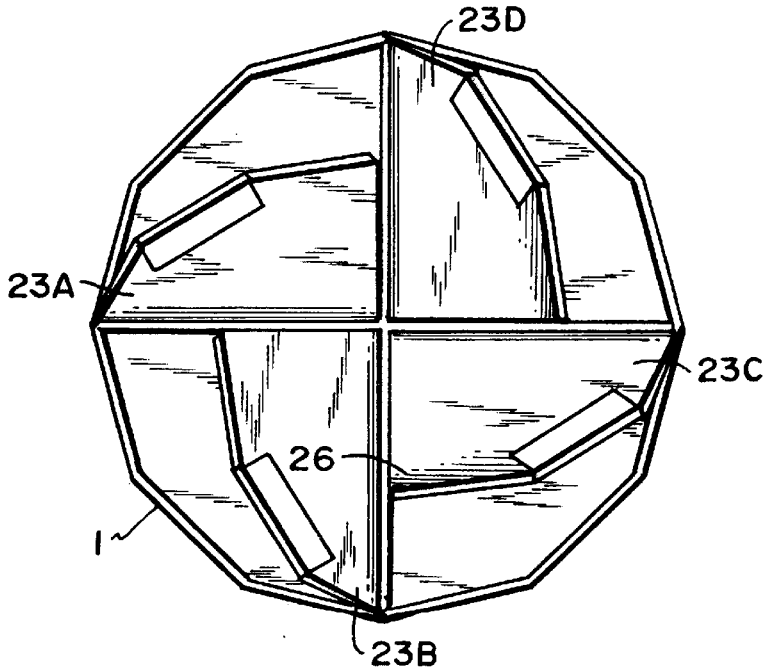
FIG. 9 is a top view of the carousel of the present invention with the cover doors open and showing compartment labels.

FIG. 9 is a top view of carousel 1 with tops 23A to 23D in partially raised position. The edges of the tops 23 conform to the octagonal shape of base 3.

Figure 10:
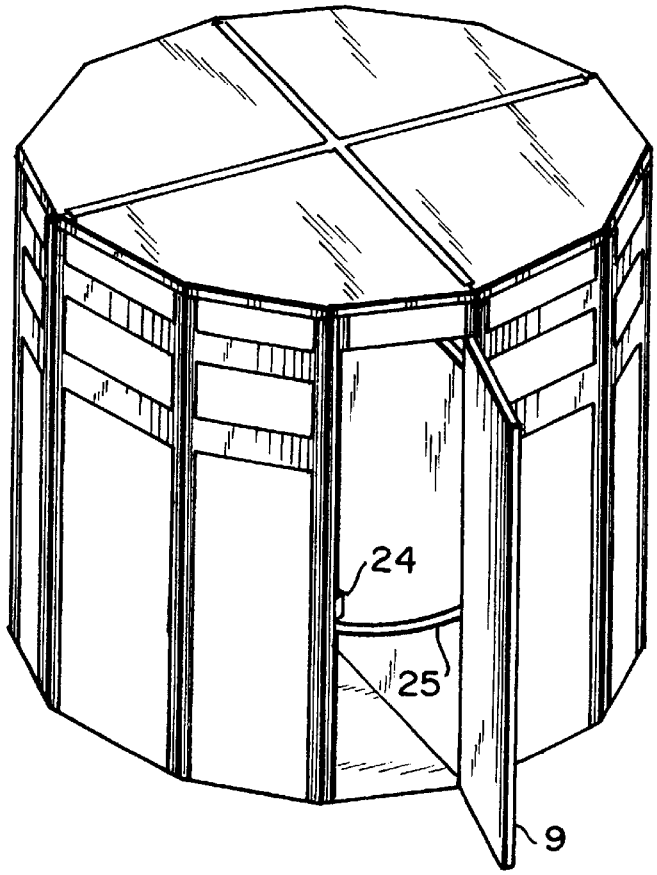
FIG. 10 is an orthogonal view of the fully assembled carousel of the present invention with a interior compartment door open.

FIG. 10 depicts the details of the individual compartments. Each door 9 providing access to a compartment is held closed by any suitable locking means 24 such as Velcro. An elastic band 25 secures the doll (not shown) in position within the compartment.

Figure 11:
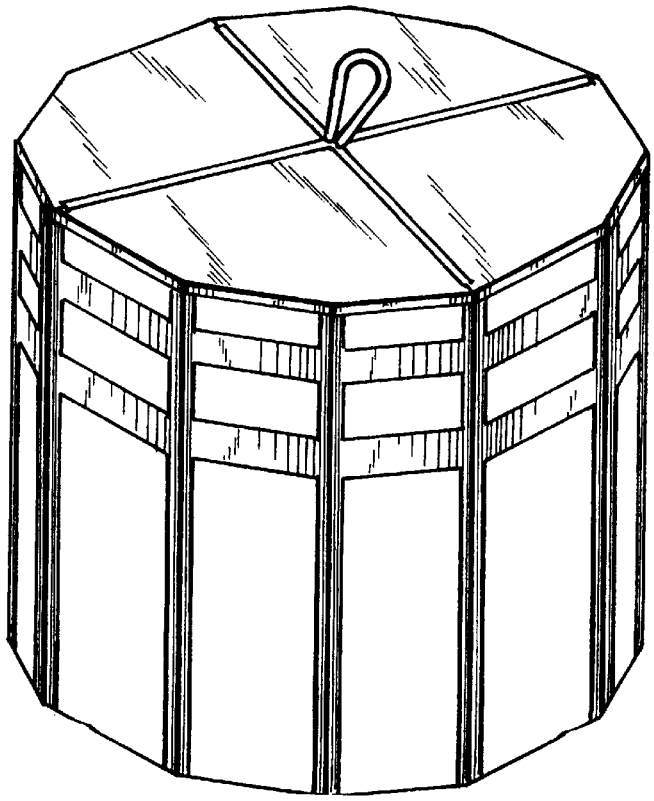
FIG. 11 is an orthogonal view of the fully assembled carousel of the present invention with labels and carrying strap affixed thereto.

FIG. 11 depicts the manner in which a doll is positioned in its individual compartment. The doll is depicted in the standing position secured by an elastic band 25 that runs from each side of the inner wall.

The handles 26 on the four top compartment doors 26 are identical to those found on the doors 26.

Figure 12:
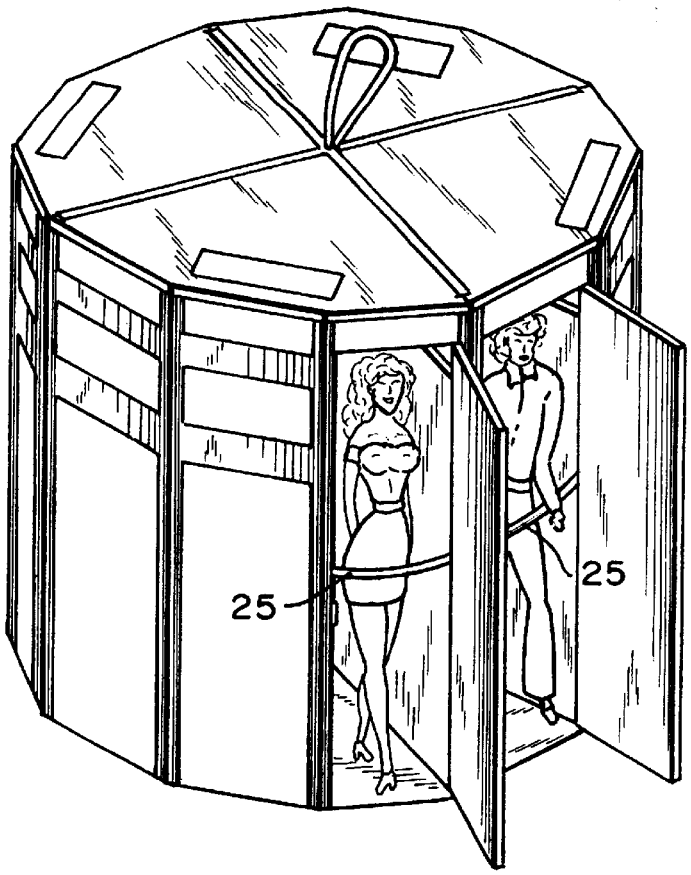
FIG. 12 is an orthogonal view of the fully assembled carousel of the present invention with two front doors open with a doll located within each compartment.
Figure 13:
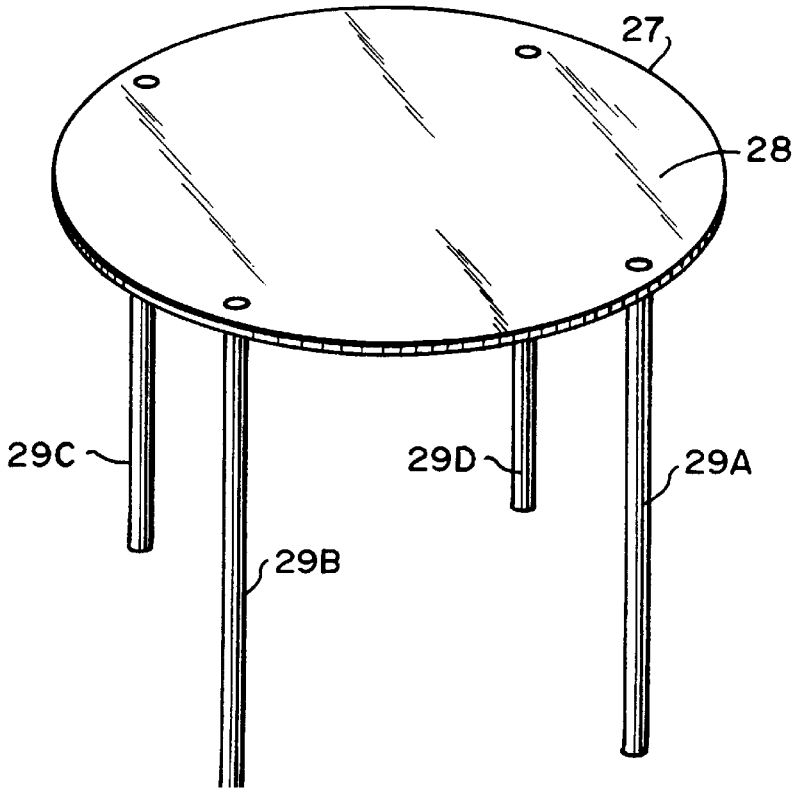
FIG. 13 is an orthogonal view of a tray used in combination with the carousel of the present invention to stack a plurality of carousels on top of one another.
Figure 14:
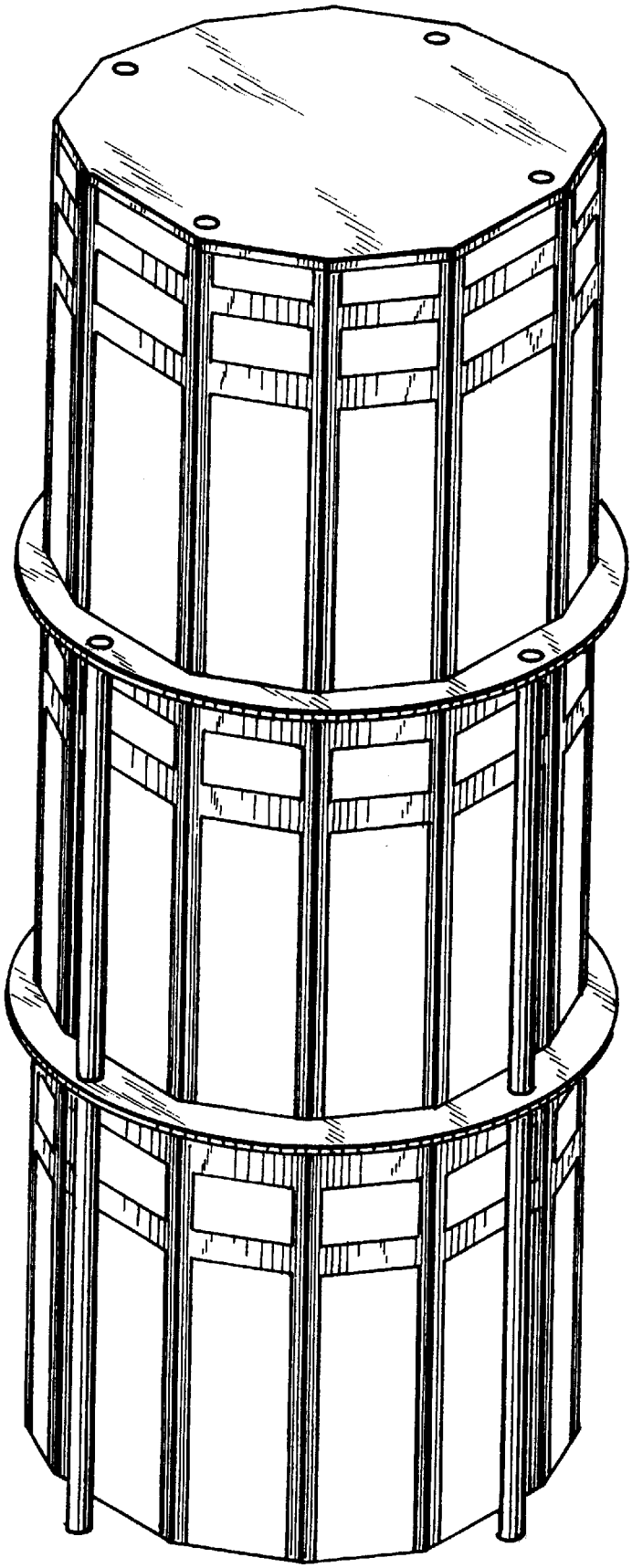
FIG. 14 is an orthogonal view of a plurality of carousels stacked on top of one another using the tray depicted in FIG. 12.

FIG. 12 is an orthogonal view of a tray 27 used in combination with the carousel of the present invention to stack a plurality of carousels on top of one another. Tray 27 comprises a base member 28 with legs 29A to 29D extending downwardly from the bottom side of tray 27. Legs 29 can be round, square or rectangular in cross section. On the top surface of tray 27 opposite to the location of legs 29A to 29D, indentations corresponding to the cross sectional area of the legs are impressed in the surface. These indentations will receive the legs of other trays when stacked one on top of the other as shown in FIG. 13. FIG. 13 is an orthogonal view of a plurality of carousels stacked on top of one another using trays depicted in FIG. 12 with the legs thereof secured in the indentations.

The disclosure of the invention as filed was covered in United States Patent Office Disclosure Document Number 391,947 filed Jan. 16, 1996.

The invention is not limited by the embodiments described above which are presented as examples only, but can be modified in various ways within the scope of protection defined by the appended patent claims.

Thus, while there have been shown and described and pointed out fundamental novel features of the invention as applied to currently preferred embodiments thereof, it will be understood that various omissions and substitutions and changes in the form and details of the method and apparatus illustrated, and in their operation, may be made by those skilled in the art without departing from the spirit of the invention. In addition it is to be understood that the drawings are not necessarily drawn to scale but that they are merely conceptual in nature. It is the intention, therefore, to be limited only as indicated by the scope of the claims appended herewith.

I claim:

1. A portable doll storage container comprising:

a base;

a plurality of segmented front walls, each said segmented front wall having an exterior face, an interior face, having identical height and width, having a bottom edge positioned adjacent said base, and having side edges which are in juxtaposition to side edges of other segmented front walls to form a polygon shaped cavity in combination with said base, one section of each said side edges of said segmented front walls being fixedly attached to said side edges of said segmented walls juxtaposed thereto;

a plurality of continuous wall partitions having top, bottom and frontal edges, said partitions being slotted and intersecting one another along their mid-planes and having the same height as said segmented front walls said wall partitions being located within said polygon shaped cavity and possessing bottom edges which contact said base;

the section of said segmented front wall not fixedly attached to a side edge of said front wall, being hingedly attached to a corresponding said frontal edge portion of said wall partition, thereby forming 2n compartments within said walls, where n is the number of wall partitions;

means for securing the edge of said segmented front wall that is not hingedly attached to said frontal edge portion of said wall partition, to said frontal edge adjacent said side edge of said front wall;

a top which is secured to said top edges of said wall partitions.

2. The portable doll storage container defined in claim 1 which further comprises a plurality of additional storage compartments formed by a sheet within said polygon shaped cavity secured to said interior face of said front segmented walls and positioned substantially parallel to said top, at least one divider sheet having first and second side edges extending radially between said interior faces of said front walls, 180 degrees and fixed thereto, said divider sheet also having top and bottom edges, said top of said portable doll storage container being hingedly fixed to said top edge of said divider sheet and not secured to said top edges of said wall partitions.

3. The portable doll storage container defined in claim 2 which further comprises a handle on said exterior face of said segmented front wall not fixedly attached to said side edges juxtaposed thereto suitable for opening said segmented front wall to expose a compartment within.

4. The portable doll storage container defined in claim 3 which further comprises a name plate panel on said exterior face of each said segmented front wall not fixedly attached to said side edges juxtaposed thereto suitable for opening said segmented front wall to identify the contents of said compartment within.

5. The portable doll storage container defined in claim 3 which further comprises a color patterned panel on said exterior face of each said segmented front wall not fixedly attached to said side edges juxtaposed thereto suitable for opening said segmented front wall to identify the contents of said compartment within.

6. The portable doll storage container defined in claim 5 which further comprises a strap handle which is fixedly secured to said wall partitions at the location where they intersect within said polygon and which extends upward through said top.

* * * * *